US005445490A

United States Patent [19]

Whitehead

[11] Patent Number: 5,445,490

[45] Date of Patent: Aug. 29, 1995

[54] BALE-CARRYING DEVICE

[75] Inventor: Roger Whitehead, Euskirchen, Germany

[73] Assignee: Sulzer Papertec Euskirchen GmbH, Germany

[21] Appl. No.: 240,728

[22] PCT Filed: Mar. 11, 1993

[86] PCT No.: PCT/DE93/00239

§ 371 Date: May 11, 1994

§ 102(e) Date: May 11, 1994

[87] PCT Pub. No.: WO93/19001

PCT Pub. Date: Sep. 30, 1993

[30] Foreign Application Priority Data

Mar. 19, 1992 [DE] Germany ..... 42 08 902.6

[51] Int. Cl.[6] ..... B66F 9/18

[52] U.S. Cl. ..... 414/607; 414/621

[58] Field of Search ..... 414/411, 412, 607, 621, 414/622, 729; 83/935

[56] References Cited

U.S. PATENT DOCUMENTS

| | | | |
|---|---|---|---|
| 3,242,851 | 3/1966 | Brawley et al. | 414/622 X |
| 4,929,141 | 5/1990 | Keesey et al. | 414/412 |
| 5,069,596 | 12/1991 | Mueller et al. | 414/607 |

FOREIGN PATENT DOCUMENTS

| | | | |
|---|---|---|---|
| 0206914 | 3/1988 | European Pat. Off. . | |
| 0281942 | 9/1988 | European Pat. Off. . | |
| 2433687 | 5/1977 | Germany . | |
| 3404794 | 8/1985 | Germany . | |
| 3540191 | 5/1987 | Germany . | |
| 8915711 | 3/1991 | Germany . | |
| 2228917 | 9/1990 | United Kingdom | 414/621 |
| 8908015 | 9/1989 | WIPO . | |
| 9205103 | 4/1992 | WIPO . | |

*Primary Examiner*—Michael S. Huppert
*Assistant Examiner*—James W. Keenan
*Attorney, Agent, or Firm*—Diller, Ramik & Wight

[57] ABSTRACT

The invention is directed to a device for carrying bales which forms an extension of a vehicle, such as a fork-lift truck. The bale-carrying device includes a frame (4) which can be fixed to the vehicle and carries a lifting device (5) which can be raised and lowered relative to the frame (4). The lifting device (5) includes two carrying arms (6, 7) which are carried by and extend from the lifting device (5) outward generally in the direction of vehicle travel. The carrying arms (6, 7) are provided with opposing vertical contact faces (8) which are parallel and can be closed to grip a bale and opened to drop a bale. Such bales are generally tied by horizontal binding wires, and to simplify the task of unbailing a bale, at least one of the two carrying arms (6) has a cutting device (10) which extends along the entire height thereof. A cutting device (10) carries a cutting blade (12) for cutting through the bale-binding wire.

16 Claims, 5 Drawing Sheets

Fig. 6
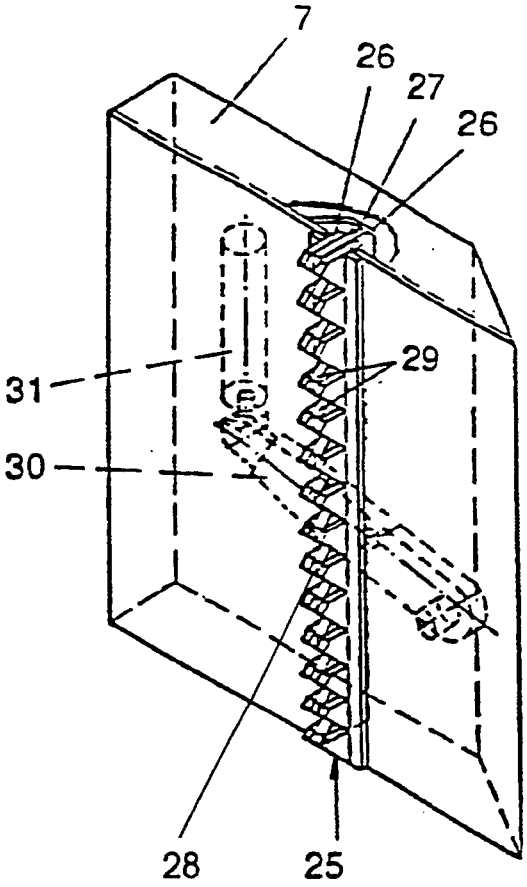
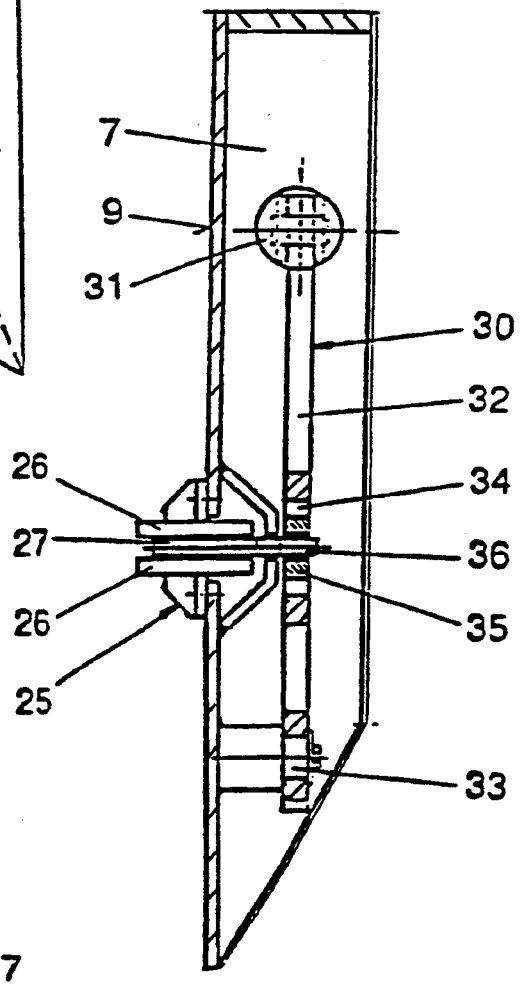
Fig. 7

BALE-CARRYING DEVICE

BACKGROUND OF THE INVENTION

The invention relates to a bale-carrying device designed as an attachment for a vehicle, in particular for a fork-lift truck, comprising a mounting frame which can be attached to the vehicle, a lifting device capable of moving up and down on the mounting frame, and two retaining arms provided on the lifting device, which essentially extend forwards from the lifting device in the direction of travel, are fitted with opposing bearing surfaces arranged roughly vertically and parallel to each other, and are mounted on the lifting device in such a manner as to be movable towards and away from each other in a lateral direction, relative to the direction of travel.

SUMMARY OF THE INVENTION

With known devices of this type, which are normally fitted to fork-lift trucks, bales are stacked, unstacked or placed on conveyor belts, on which the bales pass through wire-removing devices. Wire-removing devices are normally very elaborate and expensive machines. Furthermore, the wire-removing process represents an additional working step, for which a certain processing time must be allowed.

Thus, the task of the present invention is to simplify wire-removal and save a separate working step.

In accordance with the invention, this task is solved in that at least one of the two retaining arms of a carrying device of the type initially mentioned is provided with a cutting device, extending across almost the entire height of its bearing surface, in order to sever the binding wires of the bales.

On the basis of this invention, it is possible to remove the wire at any time at which the respective bale is located in the carrying device. A separate work step for unwiring the bales is thus saved. Furthermore, the carrying-device is also provided with certain design elements which a wire-removing device also has to display, namely a clamping mechanism with which the bale is fixed in a certain position. Thus, if the wire-removing device is integrated in the fixing device which is present anyway, and is mounted on a fork-lift truck, for example, the complexity of the device can be reduced considerably and a separate wire-removing device is saved.

The other retaining arm preferably displays a gripping device extending almost across the entire height of its bearing surface in order to grip the binding wires once cut. It is thus ensured that the cut binding wires do not fly around, but are held tight and can then be disposed of easily.

Any desired design known from conventional wire-removing devices can be used as the cutting device. However, the cutting device is preferably designed as a blade with a full-length cutting edge, which can be retracted into the bearing surface when inactive and extended from the bearing surface in order to perform the cutting process. Thus, when inactive, the cutting device is completely retracted into the interior of the retaining arm, so that, first, the cutting edge of the blade cannot present any danger to the operating personnel and, second, it is completely protected so that it cannot be damaged itself. In this condition, the carrying device, which may be mounted on a fork-lift truck, for example, can be used for normal stacking, transport or carrying tasks. The wire-removing device need then only be operated when required.

The blade of the wire-removing device is expediently movable in linear fashion in the direction of pressure of its cutting edge. This ensures that the blade is exactly vertical when it comes into contact with the binding wires to be severed, thus guaranteeing a reliable cutting process.

The blade can be movable via a lever mechanism operated with the help of a pressure cylinder. The majority of vehicles, including fork-lift trucks, for example, are fitted with pneumatic or hydraulic devices anyway, which can advantageously be used to operate the wire-removing device.

The blade of the cutting device is expediently mounted on a blade holder in replaceable fashion, so that it can be replaced with a new or reground blade without great effort, as and when required.

One very significant feature of the invention is that the bearing surface of the retaining arm bearing the cutting device is designed in concave fashion in the horizontal plane, and that the cutting edge of the blade is located roughly in the most deeply recessed region of the bearing surface. On account of this special shape of the bearing surface, the bale is curved and the binding wires are tautened on the convex side of the bale. When the cutting edge of the blade comes into contact with the tautened wires, the cutting process is facilitated considerably and the sometimes very strong binding wires are reliably severed.

The concave bearing surface of the retaining arm bearing the cutting device can also be designed as two vertical, plane-surfaced plates, arranged at an angle, between which a vertical gap is left free for the blade. Thus, the bearing surface need not be concavely curved, but can also be formed by plane-surfaced plates for design reasons. It is only important that the bale to be unwired is deformed in the position in which it is fixed, so that the binding wires become taut in the cutting area and thus considerably facilitate the cutting process.

The retaining arm provided with the gripping device can display an essentially plane bearing surface. Alternatively, however, it would also be feasible to design this bearing surface in some convex fashion, in order to support the deformation process of the bale. The gripping device can also protrude beyond the bearing surface and thus initiate the deformation process of the bale.

It is expedient for the gripping device to comprise at least two rows of teeth which can be moved relative to each other, with the teeth of at least one of the rows of teeth each displaying an undercut. The undercuts of the teeth ensure that the severed wires can be positively held in place in the rows of teeth.

In a preferred embodiment of the gripping device, this comprises two rows of teeth, arranged at a distance from each other and fixed on the bearing surface of the retaining arm, between which a further row of teeth is provided, being guided in longitudinally sliding fashion. In this context, the row of teeth which can be guided in sliding fashion is expediently provided with the teeth with undercuts.

The sides of the teeth which face away from the undercuts can each be provided with a bevel. This gives rise to the advantage that the retained wires are pressed out when the teeth are drawn back and self-cleaning of the gripping device is thus initiated.

The row of teeth guided in longitudinally sliding fashion can be operable via a lever mechanism operable with the help of a pressure cylinder, so that the gripping device can also be powered via the operating mechanism available as standard on fork-lift trucks, for example.

A row of prongs can be provided on the bearing surface of the retaining arm fitted with the gripping device, arranged at a distance from the rows of teeth and parallel to them, these prongs serving, for example, to support the deformation process of densely packed bales. The binding wires can then slide between the prongs during deformation of the bale and thus be lifted off the bale so that they can be reliably gripped by the gripping device.

To allow universal use of the device according to the invention, the front sides of the retaining arms can be provided with a wedge-shaped, tapered area extending across their entire height. This enables the device to remove bales from densely packed stacks as the retaining arms can easily be inserted between the bales.

BRIEF DESCRIPTION OF THE DRAWINGS

An example of the invention is illustrated in the drawings and described in detail below on the basis of the drawings. The drawings show the following:

FIG. 7: a horizontal section through the retaining arm according to FIG. 6, FIG. 8: the same section as in FIG. 7, but through an example of a modification of the retaining arm according to FIG. 6, and FIG. 9: a view of the row of prongs in the direction of arrow IX in FIG. 8.

DESCRIPTION OF THE PREFERRED EMBODIMENTS

Figure 1:
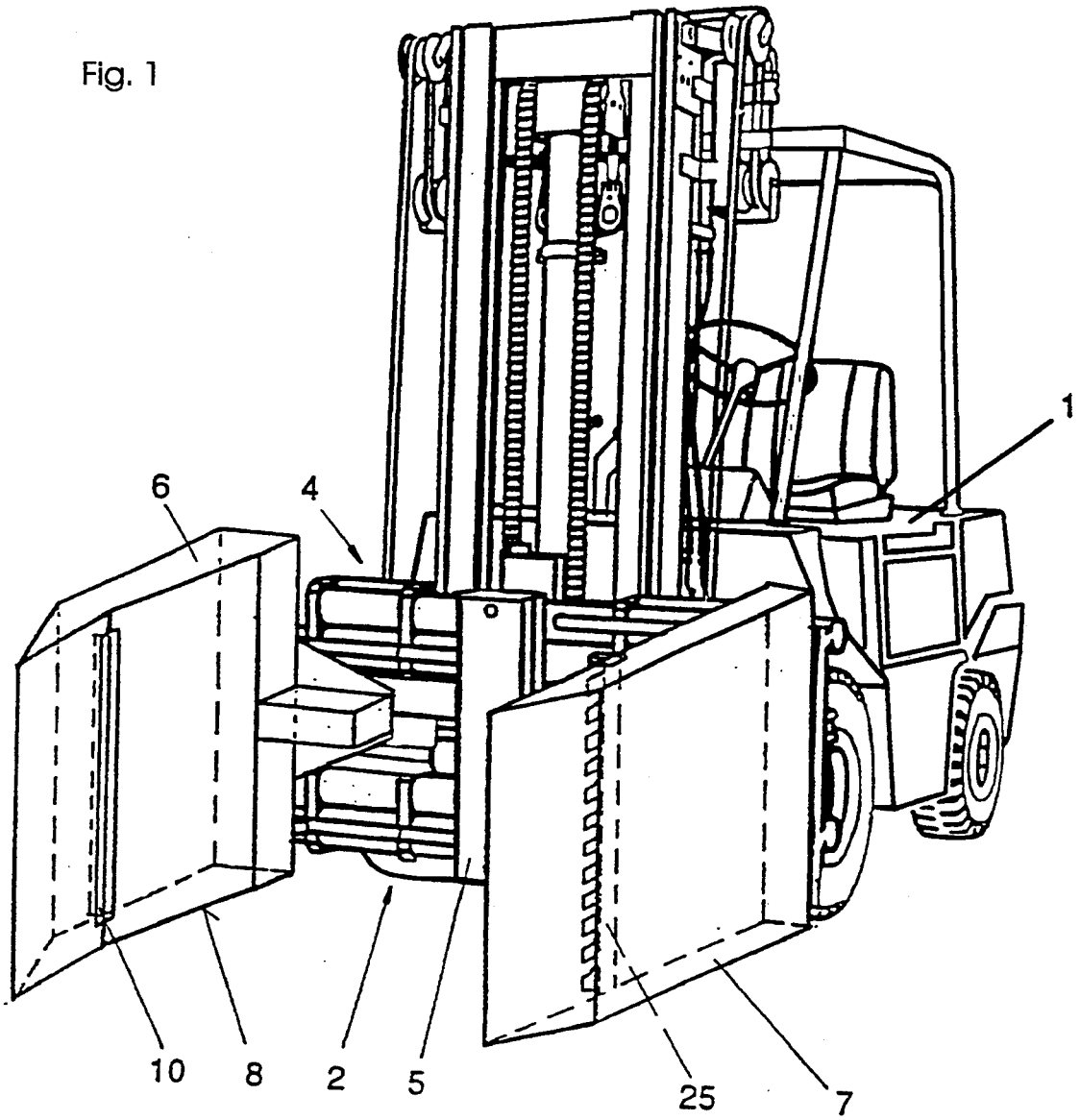
FIG. 1: the carrying device according to the invention, mounted on a fork-lift truck.

FIG. 1 of the drawings shows a fork-lift truck 1, fitted with a carrying device 2 for bales 3.

Figure 2:
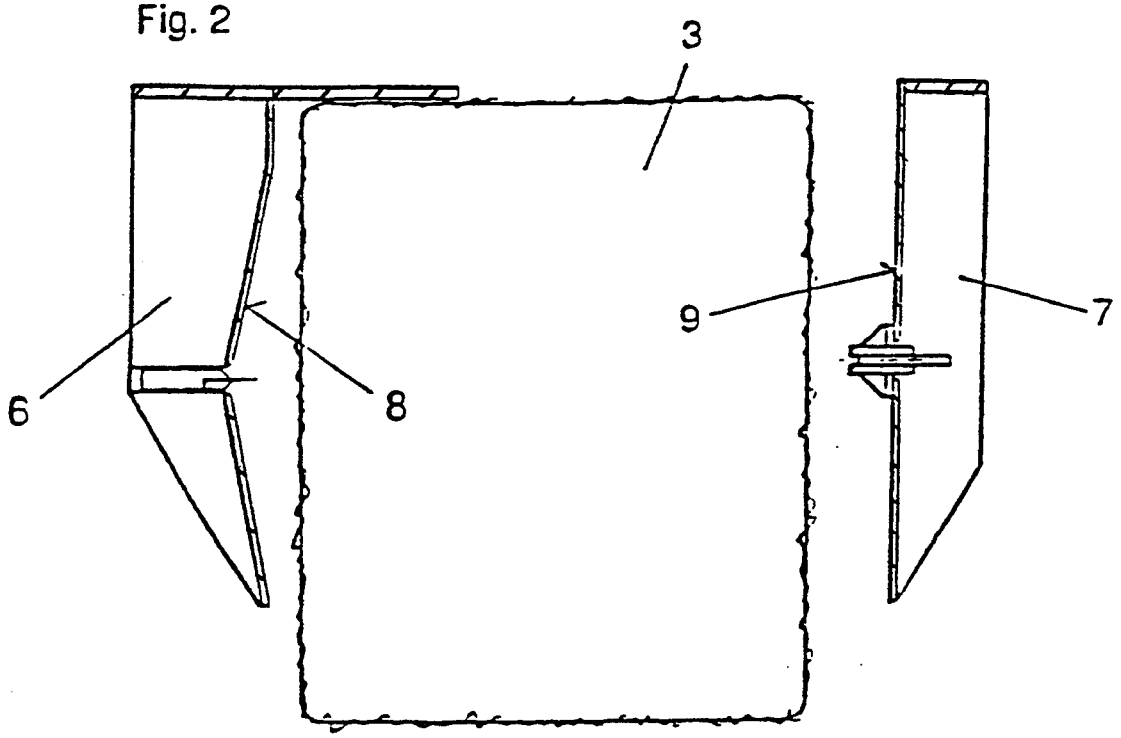
FIG. 2: a top view of the retaining arms before gripping a bale.

The carrying device in this case is designed as an attachment on the fork-lift truck 1 and essentially consists of a mounting frame 4 which can be attached to the fork-lift truck 1, a lifting device 5 capable of moving up and down on the mounting frame, as well as two retaining arms 6 and 7 which extend forwards from the lifting device 5 in the direction of travel. The retaining arms 6 and 7, which are mounted on the lifting device 5 in such a manner as to be movable towards and away from each other in a lateral direction, relative to the direction of travel, are fitted with roughly vertical, opposing bearing surfaces 8 and 9, with which a bale 3 can be reliably gripped and held in place, as presented schematically in FIGS. 2 and 3.

Figure 3:
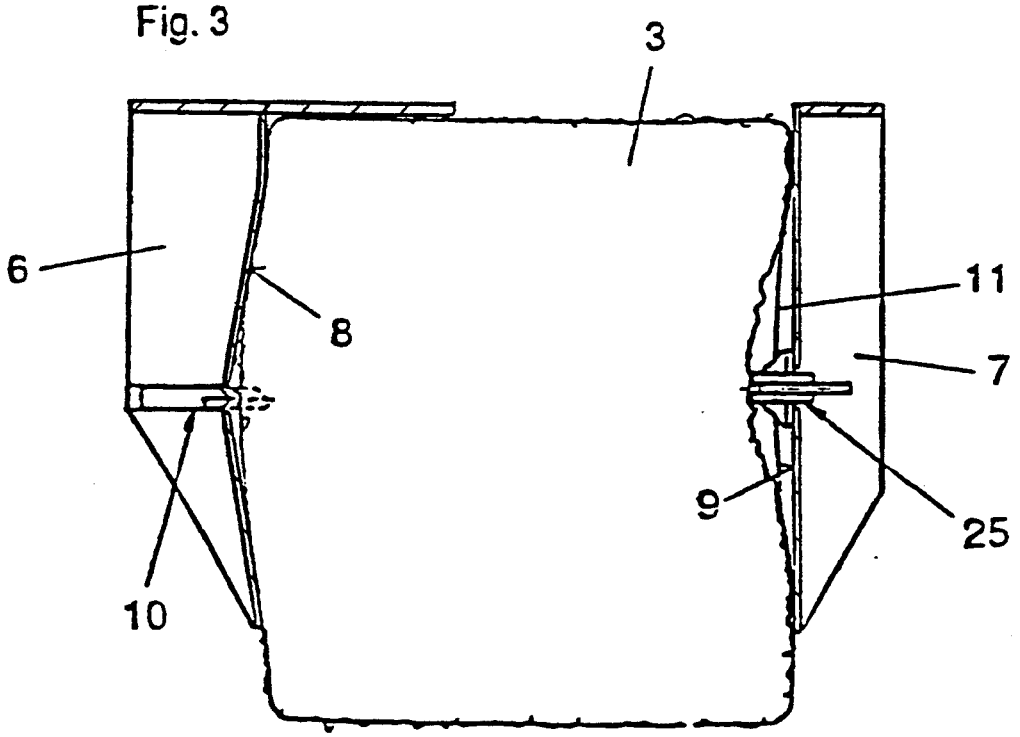
FIG. 3: a top view of the retaining arms after gripping a bale.
Figure 5:
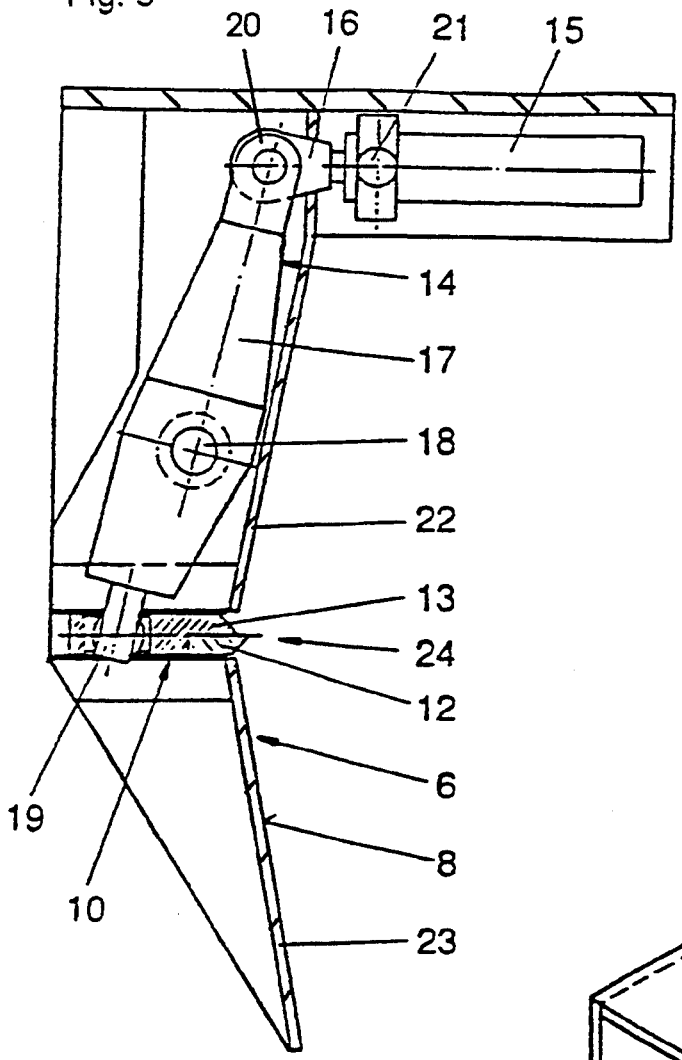
FIG. 5: an enlarged view of a horizontal section through the retaining arm according to FIG. 4, FIG. 6: a perspective view of the retaining arm fitted with the gripping device, partially in section form.
Figure 4:
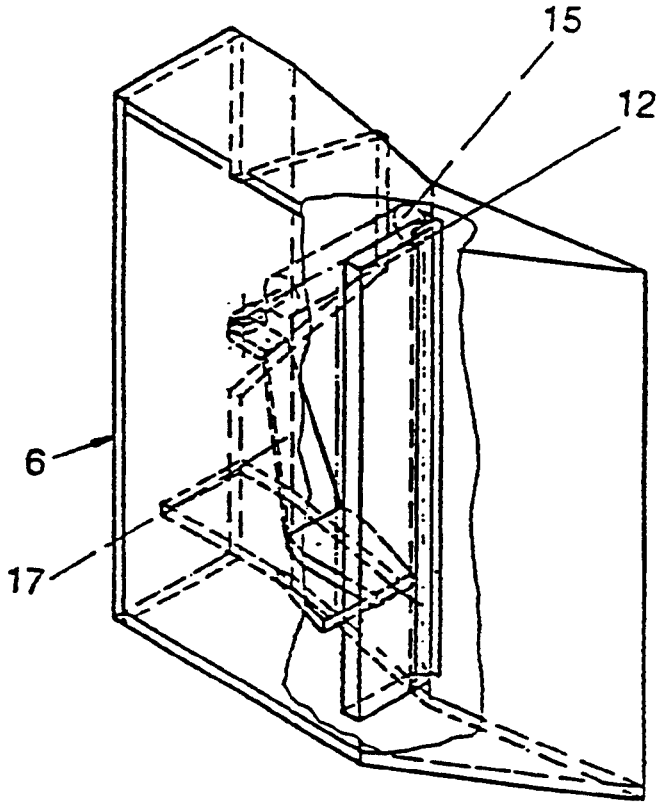
FIG. 4: a perspective view of the retaining arm fitted with the cutting device, partially in section form.

As can be seen in FIGS. 4 and 5, in particular, the retaining arm 6 is provided with a cutting device 10, extending across almost the entire height of its bearing surface 8, with which the binding wires 11 which can be seen in FIG. 3 can be reliably severed. The cutting device 10 essentially consists of a blade 12 with a full-length cutting edge. The blade 12 is mounted in detachable fashion on a blade holder 13, which is guided in the retaining arm 6 so as to be movable in a straight line in the direction of pressure of the cutting edge of the blade 12.

A lever mechanism 14, which can be operated with the help of a pressure cylinder 15 and is housed in the retaining arm 6, serves to move the blade 12. The pressure cylinder 15 is connected to the hydraulic system with which the fork-lift truck 1 is fitted as standard, and can be operated from the driver's seat. The piston rod 16 of the pressure cylinder 15 then transfers the power to the lever mechanism 14.

The lever mechanism 14 essentially consists of a two-armed lever 17, the middle section of which can be rotated around an axle 18. The end of the lever 19 facing the cutting device 10 is mounted in the blade holder 13 in rotatable and axially movable fashion, so that when the lever 17 is rotated, its rotary movement can be converted into a linear movement of the blade holder. The other end 20 of the lever 17 is connected to the piston rod 16 in rotatable fashion. In order to enable the linear movement of the piston rod 16 to be converted into a rotary movement of the lever 17, the pressure cylinder 15 is mounted so as to be rotatable about an axle 21.

As can be seen in FIG. 5, in particular, the bearing surface 8 of the retaining arm 6 is designed in concave form, with the concave shape created by two plane plates 22 and 23, located vertically on the retaining arm 6. The two plates 22 and 23 leave a vertical gap 24 free between them in order to accommodate the blade 12. In this manner, the blade 12 is housed in roughly the most deeply recessed area of the bearing surface 8 and is retracted into the bearing surface 8 when inactive, so that it is located in the interior of the retaining arm 6. In order to execute the cutting process, the blade 12 moves through the vertical gap 24 and protrudes beyond the bearing surface 8.

The other retaining arm 7, which is presented in detail in FIGS. 6 and 7, is provided with a gripping device 25, which extends across almost the entire height of its essentially plane bearing surface 9 and serves to hold the severed binding wires 11 firmly in place.

The gripping device 25 consists of two rows of teeth 26, arranged at a distance from each other in a fixed position relative to the bearing surface 9, between which a further row of teeth 27 is guided in longitudinally sliding fashion. The teeth 28 of the movable row of teeth 27 are provided with undercuts on the downward-pointing side shown in FIG. 6, while the upward-facing sides of the teeth shown in FIG. 7 are each provided with a bevel 29.

In order to grip the binding wires 11 recognisable in FIG. 3, the middle row of teeth 27 moves a short distance downwards, whereby the binding wires 11 move behind the undercuts of the teeth 28 and can thus be held firmly in place. In order to free the binding wires from the gripping device 25, the middle row of teeth 27 moves upwards, causing the binding wires to come into contact with the bevel 29 of the next respective tooth 28, and thus to be forced out of the gaps between the teeth. This enables easy removal of the wires.

Like the cutting device, the movable row of teeth 27 can be operated with the help of a lever mechanism 30, which is powered by means of a pressure cylinder 31. The lever mechanism 30 comprises a one-armed lever 32, mounted in rotatable fashion on an axle 33 fixed to the retaining arm 7. The piston rod of the pressure cylinder 31, mounted in rotatable fashion, acts on the end of the lever 32 facing away from the axle 33. The middle section of the lever 32 is provided with a slot 34, in which a guide shoe 35 is guided in longitudinally sliding fashion. The guide shoe 35 is engaged by a catch 36 which is connected to the movable row of teeth 27. When the lever 32 is rotated, the row of teeth 27 executes a longitudinal movement up or down.

Figure 8:
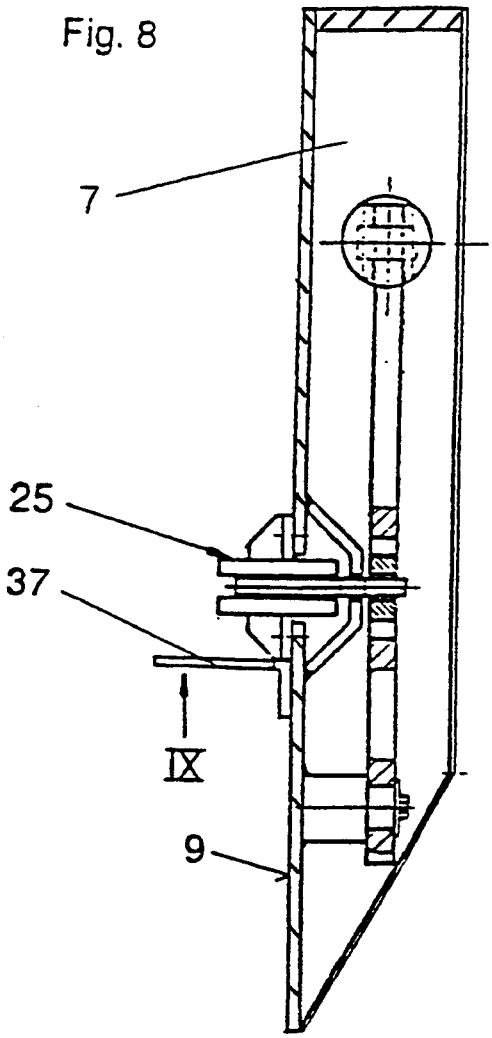
Figure 9:
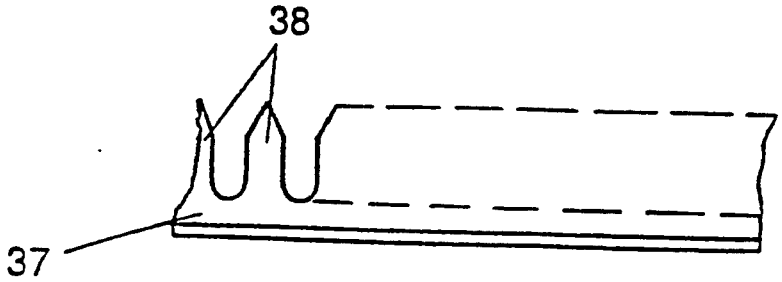

In the case of the example of an embodiment of the retaining arm 7 presented in FIGS. 8 and 9, a row of prongs 37 is arranged directly alongside and parallel to the gripping device 25. This essentially consists of an L-section, the short leg of which is attached to the bearing surface 9 of the retaining arm 7, while the long leg is provided with recesses at regular intervals, creating individual prongs 38. These press against the bale 3 when the holding arms are moved together and thus support the deformation of the bale in the space created by the plates 22 and 23 of the retaining arm 6.

As can be seen in FIG. 3, in particular, the bale 3 takes on a curved appearance when gripped, so that the binding wires 11, located against the bearing surface 8 of the retaining arm 6, become taut and can thus be easily severed with the help of the cutting device 10. On the opposite side, the binding wires 11 are clear and can thus easily be taken up by the gripping device 25.

Thus, when in-operation, it is possible to use the carrying device 2 in a conventional sense for stacking and transporting bales. If cutting of the binding wires 11 is desired, the cutting mechanism is triggered by operating a lever located near to the driver's seat during the carrying cycle, this causing the blade 12 to travel forward and sever the tautened binding wires 11, while the gripping device 25 on the opposite side closes and holds the severed wires 11 firmly in place. Once the retaining arms 6 and 7 have moved apart, the unwired bale 3 is released, while the cut ends of the wires are still located in the gripping device 25 and can be removed at any point, as desired.

The special value of the invention is not only that wire removal is simplified, but also that the wire-removal and gripping cycles themselves are considerably improved and simplified in comparison with conventional wire-removal devices.

| Reference numbers | |
|---|---|
| 1 | Fork-lift truck |
| 2 | Carrying device |
| 3 | Bale |
| 4 | Mounting frame |
| 5 | Lifting device |
| 6 | Retaining arm |
| 7 | Retaining arm |
| 8 | Bearing surface |
| 9 | Bearing surface |
| 10 | Cutting device |
| 11 | Binding wires |
| 12 | Blade |
| 13 | Blade holder |
| 14 | Lever mechanism |
| 15 | Pressure cylinder |
| 16 | Piston rod |
| 17 | Two-armed lever |
| 18 | Axle |

-continued

| Reference numbers | |
|---|---|
| 19 | Lever end |
| 20 | Lever end |
| 21 | Axle |
| 22 | Plate |
| 23 | Plate |
| 24 | Gap |
| 25 | Gripping device |
| 26 | Rows of teeth |
| 27 | Movable row of teeth |
| 28 | Teeth |
| 29 | Bevel |
| 30 | Lever mechanism |
| 31 | Pressure cylinder |
| 32 | One-armed lever |
| 33 | Axle |
| 34 | Slot |
| 35 | Guide shoe |
| 36 | Catch |
| 37 | Row of prongs |
| 38 | Prongs |

What is claimed is:

1. A bale-carrying device comprising a mounting frame adapted to be attached to a vehicle, a lifting device constructed and arranged for moving up and down on the mounting frame, two retaining arms carried by and extending from the lifting device in the direction of vehicle travel, said retaining arms being fitted with opposing bale engaging bearing surfaces arranged substantially vertically and parallel to each other and being mounted on the lifting device for movement towards and away from each other in a lateral direction relative to the direction of vehicle travel and at least one of said two retaining arms (6) carrying a cutting device (10) extending substantially the entire height of its bearing surface (8) in order to sever a binding wire (11) horizontally encircling a bale (3) disposed between said opposing bearing surfaces.

2. The bale-carrying device as defined in claim 1 wherein one of the retaining arms (7) carries a gripping device (25) extending across substantially the entire height of its bearing surface (9) in order to hold a binding wire (11) firmly in place.

3. A bale-carrying device as defined in claim 2 wherein the retaining arm (7) carrying the gripping device (25) has a substantially planar bearing surface (9).

4. The bale-carrying device as defined in claim 2 wherein the gripping device (25) includes at least two rows of teeth (26, 27) which can be moved relative to each other, and the teeth (28) of at least one of the rows of teeth (27) are undercut.

5. The bale-carrying device as defined in claim 4 wherein the gripping device (25) comprises two rows of teeth (26) spaced a distance from each other and fixed on the bearing surface (9) of the retaining arm (7), and a further row of teeth (27) guided in longitudinally sliding relationship between said two rows of teeth.

6. The bale-carrying device as defined in claim 5 wherein the further row of sliding teeth (27) includes undercut teeth (28).

7. The bale-carrying device as defined in claim 6 wherein sides of the undercut teeth (28) facing away from undercuts thereof are each provided with a bevel (29).

8. The bale-carrying device as defined in claim 5 wherein the further row of sliding teeth (27) can be moved via a lever mechanism (30) operated by a pressure cylinder (31).

9. The bale-carrying device as defined in claim 4 wherein a row of prongs (37) is provided on the bearing surface (9) of the retaining arm (7) carrying the gripping device (25) spaced from and parallel to the rows of teeth.

10. The bale-carrying device as defined in claim 1 wherein the cutting device (10) includes a blade (12) having a cutting edge which can be retracted into the bearing surface (8) when inactive and can be moved forward out of the bearing surface (8) to sever a binding wire (8).

11. A bale-carrying device as defined in claim 10, wherein the blade (12) can be moved in a straight line in a direction substantially normal to a cutting edge thereof.

12. A bale-carrying device as defined in claim 11, wherein the blade (12) is movable by a lever mechanism (14) operated by a pressure cylinder (15).

13. A bale-carrying device as defined in claim 10 wherein the blade (12) is replaceably mounted on a blade holder (13).

14. A bale-carrying device as defined in claim 10 wherein the bearing surface (8) of the at least one retaining arm (6) carrying the cutting device (10) has a horizontal cross-section of a concave configuration and the cutting edge of the blade (12) is located substantially in a most deeply recessed region of said concave bearing surface (8).

15. A bale-carrying device as defined in defined in claim 14 wherein the concave bearing surface (8) of the retaining arm (6) carrying the cutting device (10) is defined by two vertical plates (22, 23) arranged at an angle to each other and between which is a vertical gap (24) receiving the blade (12).

16. The bale-carrying device as defined in claim 1 wherein front sides of the retaining arms (6, 7) are each provided with a wedge-shaped tapered area along their entire height.

* * * * *